US005685788A

United States Patent [19]

Shy et al.

[11] Patent Number: 5,685,788

[45] Date of Patent: Nov. 11, 1997

[54] SHOCK-ABSORBABLE BALL PRACTICE DEVICE

[76] Inventors: Haw-Yaw Shy; Jer-Min Liaw, both of P.O. Box 55-1670, Taipei (104), Taiwan

[21] Appl. No.: 638,952

[22] Filed: Apr. 25, 1996

[51] Int. Cl.[6] ..... A63B 69/40

[52] U.S. Cl. ..... 473/423

[58] Field of Search ..... 273/26 D, 26 R, 273/26 E, 58 C, 413; 473/393, 394, 395, 396, 397, 423

[56] References Cited

U.S. PATENT DOCUMENTS 4,531,734 7/1985 Herrick ..... 273/58 C
4,616,834 10/1986 Davis ..... 273/58 C
5,282,615 2/1994 Green ..... 273/26 E
5,435,545 7/1995 Marotta ..... 273/26 R
5,467,978 11/1995 Paluch ..... 273/413

*Primary Examiner*—Theatrice Brown

[57] ABSTRACT

A ball practice device includes: a base member having a plurality of branch leg members branched from the base member, a plurality of cushioning pads each cushioning pad which may be a sandbag worn or secured on an end portion of each branch leg member of the base member, a telescopic post erected on a central portion of the base member, and a ball secured to the telescopic post by a connector, whereby upon batting or striking of the ball, the vibractional shock caused by the impact force for batting the ball will be dampened or depressed by the plurality of the cushioning pads for absorbing shock for preventing injury to the ball practice player.

3 Claims, 4 Drawing Sheets

SHOCK-ABSORBABLE BALL PRACTICE DEVICE

BACKGROUND OF THE INVENTION

U.S. Pat. Nos. 4,903,966 and 4,508,340 to Leon Liao disclosed a ball batting and striking practice device having a single base member which may be fastened on a single sandbag for erecting the ball supporting member on the base member.

However, the single base of the ball practice even fastened on a single sandbag may have the following drawbacks:

1. The single sandbag after being fully filled with sand therein will be so heavy to be carried by a ball player, causing inconvenience for the player.

2. If the ground surface for laying the single sandbag thereon is corrugated, the single sandbag will be tilted to unstably hold the supporting member of the ball.

3. In consideration of the convenient portability of the single sandbag, the weight and volume of the single sandbag should be suitably limited, thereby reducing the area of the sandbag for supporting the ball practice device and therefore reducing its shock damping force and decreasing the stability of the ball practice device.

4. The base member is fastened on the sandbag by screws, causing inconvenience for assembling and detaching the ball practice device.

5. When subjected to an impact force by batting or striking a ball secured on the supporting member and base member, the impact force, which would be shared or dampened by a plurality of cushioning pads if otherwise provided, is all acting upon the single sandbag of the conventional single sandbag so that the shock absorbing effect by the conventional single sandbag is quite limited.

The present inventors have found the drawbacks of the conventional ball practice device, and invented the present shock-absorbable ball practice device.

SUMMARY OF THE INVENTION

The object of the present invention is to provide a ball practice device including: a base member having a plurality of branch leg members branched from the base member, a plurality of cushioning pads each cushioning pad which may be a sandbag worn or secured on an end portion of each branch leg member of the base member, a telescopic post erected on a central portion of the base member, and a ball secured to the telescopic post by a connector, whereby upon batting or striking of the ball, the vibrational shock caused by the impact force for batting the ball will be dampened or depressed by the plurality of the cushioning pads for absorbing shock for a comfortable ball practice and for preventing injury to the ball practice player.

DETAILED DESCRIPTION

Figure 1:
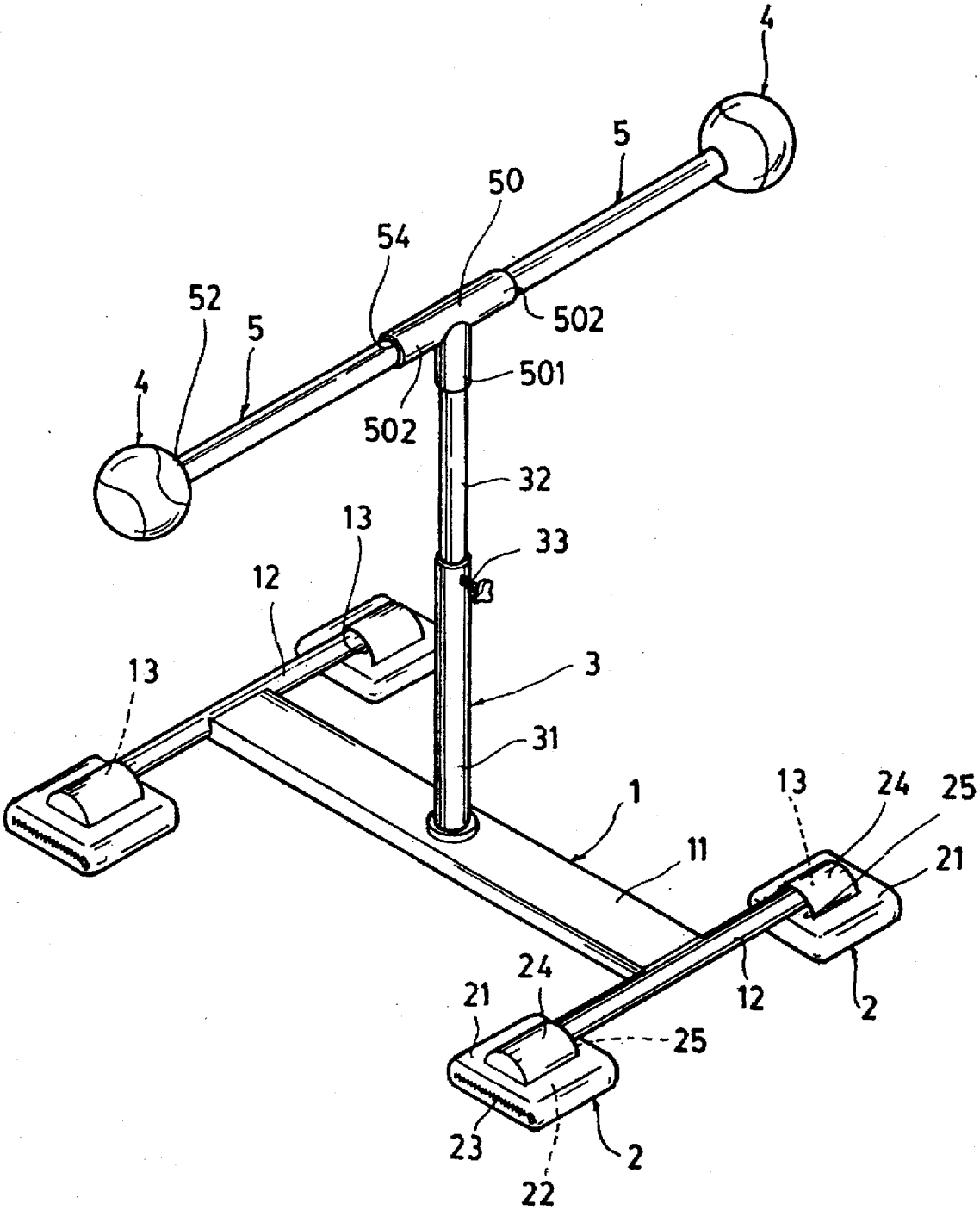
FIG. 1 is a perspective view of a ball practice device having a pair of balls disposed on two opposite ends of a connector secured on the post in accordance with the present invention.
Figure 2:
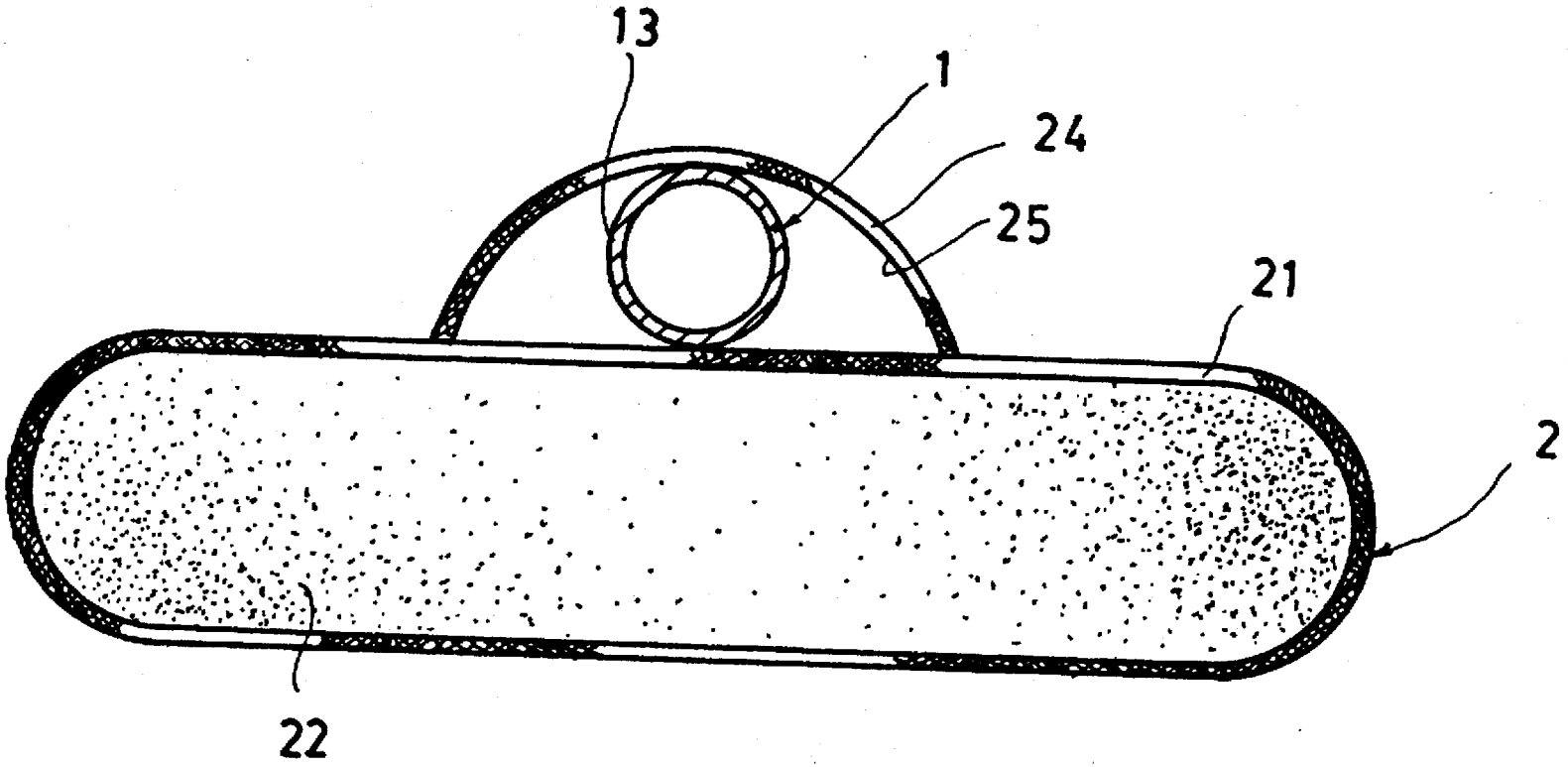
FIG. 2 is a sectional drawing of a shock absorbing member of the present invention.

As shown in FIGS. 1–4, a preferred embodiment of the present invention comprises: a base member 1, a plurality of shock absorbing members 2 secured to the base member 1, a telescopic post 3 telescopically erected on the base member 1, and a ball 4 secured to the telescopic post 3 by a connecting means 5.

The base member 1 includes: a base plate 11, a plurality of branch leg members 12 branched from the base plate 11 with each leg member 12 having an end portion 13 for securing each shock absorbing member 2 on the end portion 13 of the leg member 12.

The leg members 12 may be bifurcated, trifurcated or branched into a plurality of leg members 12 from the base plate 11.

Each shock absorbing member 2 includes: a cushioning pad 21 which may be a sandbag filled with fillers 22 such as sand, a fastener 23 which may be a zipper fastener for fastening a bag opening formed in the pad 21 for filling filler 22 into the pad 21 through the bag opening which is closed by the fastener 23, and a sleeve portion 24 formed on a top surface of the pad 21 having a socket 25 recessed in the sleeve portion 24 for engaging an end portion 13 of each branch leg member 12 of the base member 1.

Each shock absorbing member 2 is detachably secured to the leg member 12 of the base member 1 for easier assembly and maintenance of the present invention.

The telescopic post 3 includes: an outer tube 31 perpendicularly mounted on the base plate 11 of the base member 1, at least an inner tube 32 telescopically held in the outer tube 31 with the inner tube 32 adjustably lockable on or above the outer tube 31 by a locking means 33, whereby upon a fastening of the locking means 33, the inner tube 32 may be upwardly extended and stably positioned above the outer tube 31 as locked by the locking means 33 and upon a withdrawal of the inner tube 32 from the outer tube 31, the inner tube 32 may be disassembled or detached from the outer tube 31. The locking means 33 may be modified with a plurality of diversified designs for adjusting the extended height of the telescopic post 3, not limited in the present invention.

Figure 3:
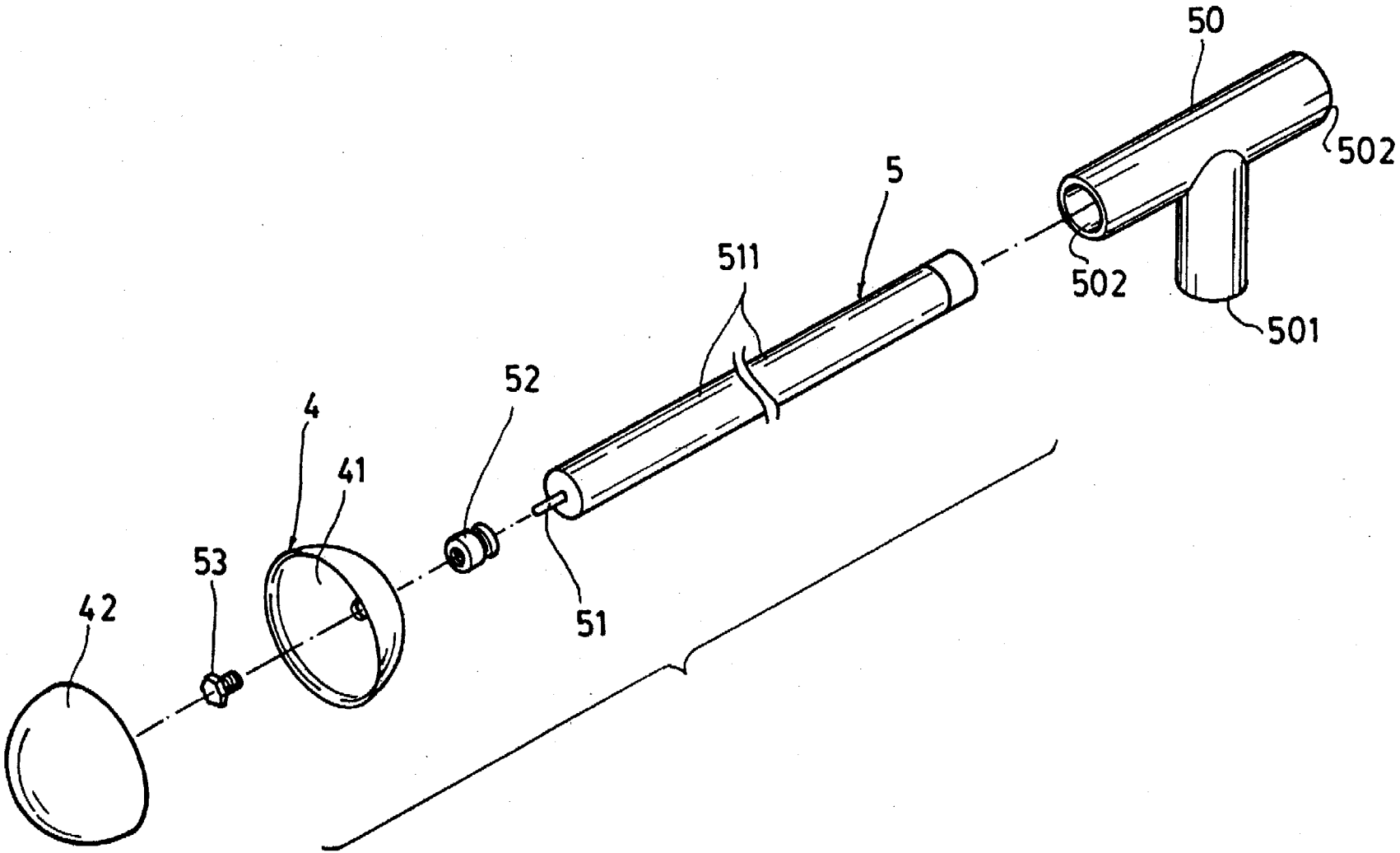
FIG. 3 shows a connecting means for connecting a ball to the post of the present invention.
Figure 4:
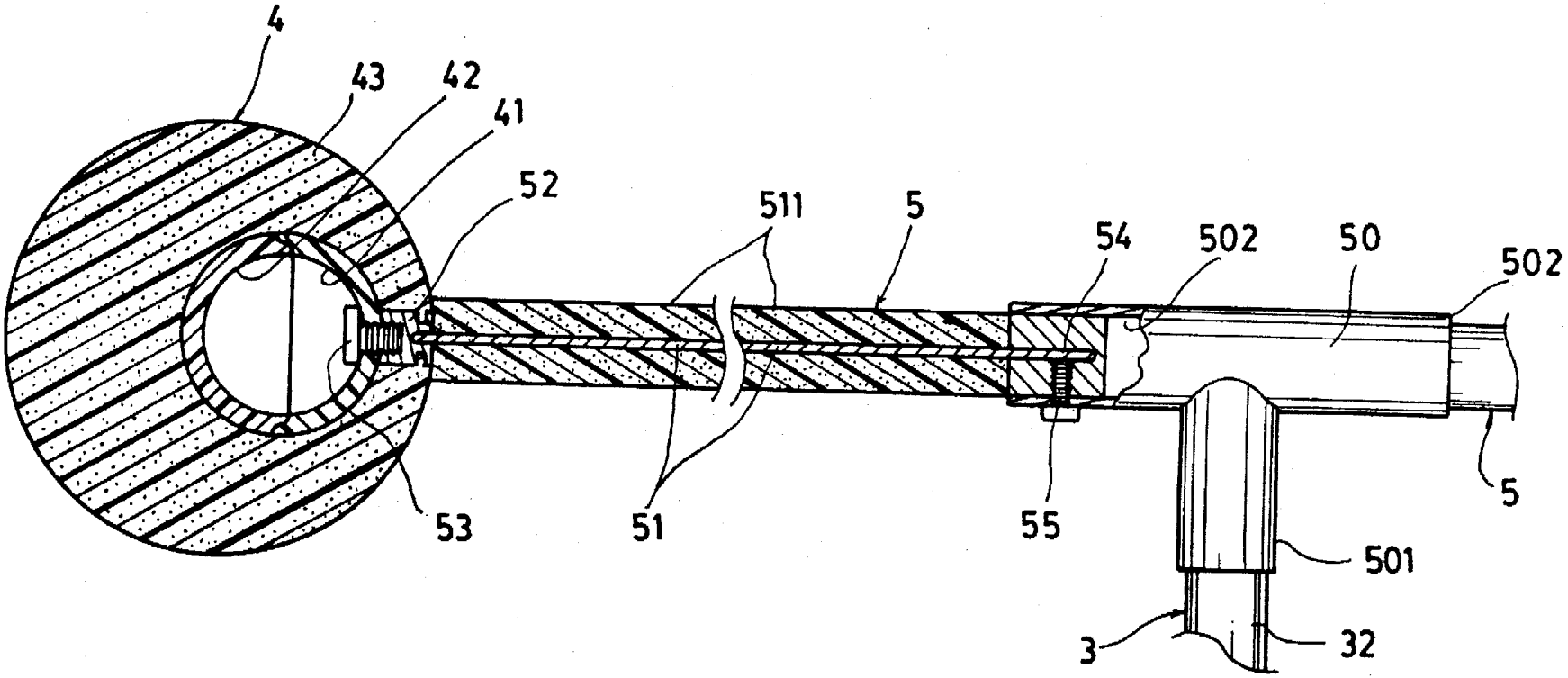
FIG. 4 is a partial sectional drawing of the ball and its connecting means as assembled from FIG. 3.

The ball 4 may be a baseball or balls of other games, not limited in the present invention. As shown in FIGS. 3, 4, the ball 4 is a solid baseball which includes a pair of semi-spherical core members 41, 42 combinable to form a core and an outer solid member 43 disposed around and integrally formed with the core 41, 42 such as made by plastic injection molding process.

For dynamic balancing, a pair of balls 4 are symmetrically disposed on two opposite sides of the central telescopic post 3 by a pair of connecting means 5. If each connecting means and each ball 4 is bent inclinedly downwardly, the ball 4 may also simulate a golf ball for practicing the striking of a golf ball (not shown).

Each connecting means 5 includes: a connecting wire or rod 51 having a flexible elastomer coating 511 coated on the wire or rod 51, an outer retainer 52 formed at an outer end of the connecting wire 51 for securing the core member 41 by a fixing screw 53, and an inner end portion 54 of the connecting wire 51 connected to a T connector 50 by a fixing screw 55.

The T connector 50 includes a vertical adapter 501 connected with an upper end of the inner tube 32 of the telescopic post 3, and a pair of horizontal adapters 502 perpendicularly secured on the vertical adapter 501 for respectively connecting the pair of connecting wires 51 having a pair of balls 4 each ball secured on an outer end of each connecting wire 51.

The ball 4 may be modified to be other structures, and designs for different diversified ball games, not limited in the present invention.

The present invention is superior to the conventional ball practice devices with the following advantages:

1. The plurality of cushioning pads 21 of sandbags as secured on the plural branch leg members 12 branched from the base member 1 will greatly dampen the vibrational shock during the striking and batting of the balls to prevent injury to the player and also to enhance a comfortable ball practice.

2. Each shock absorbing member 2 is detachably secured with the leg member 12 for a convenient assembly or disassembly when erecting or dismantling the ball practice device. Each pad or sandbag 21 may be filled with filler such as sand just by the player himself or herself by easily picking up the sand from the family yard or other sources.

3. The plural cushioning pads 21 will occupy a big supporting area for reducing the pressure per unit area when receiving the impact force upon striking the ball, thereby greatly minimizing and damping the shock caused by the impact force.

4. The base member "riding" on the plural pads 21 may be horizontally levelled in order for stably supporting the base member and the post for a smooth ball practice.

5. The pads 21 may be evacuated by removing their fillers 22 for a light-weight carrying, storage or handling for enhancing the portability of the ball practice device.

6. The two balls 4 as symmetrically disposed on two opposite sides of the central post 3 will enforce a dynamic balancing during the rotation of the balls and the connecting means 5 for minimizing the shock problem.

The present invention may be used for plural kinds of ball games, such as: baseball, tennis, golf and other ball games, not limited in the present invention.

The present invention may be modified without departing from the spirit and scope as claimed hereinafter. The preferred examples as shown in the accompanying drawings are provided for explaining the present invention only, not for limiting the scope thereof.

We claim:

1. A ball practice device comprising:

a base member having a base plate, a plurality of branch leg members branched from the base plate, each branch leg having an end portion;

a plurality of shock absorbing members each detachably secured to an end portion of each said branch leg member, each said shock absorbing member including: a cushioning pad filled with filler material, a fastener for closing an opening formed in said pad;

a sleeve portion formed on a top surface of the pad having a socket recessed in said sleeve portion for engaging said end portion of each said branch leg member of the base member; and a vertically extending telescopic post telescopically mounted on said base plate of said base member, said telescopic post having a T connector secured on a top of said post for connecting a pair of connecting means symmetrically disposed on opposite sides of said T connector, each said connecting means having a ball secured thereon for a dynamic balancing when a said ball is struck by a batter.

2. A ball practice device according to claim 1, wherein said filler material is sand.

3. A ball practice device according to claim 1, wherein each said connecting means includes: a connecting wire encased in a flexible elastomer coating, an outer retainer formed at an outer end of the connecting wire for securing a core member of the ball, and an inner end portion of the connecting wire connected to an upper portion of said telescopic post by said T connector, said core member being integrally enclosed in an elastomer material to form said ball.

* * * * *